US009791121B2

(12) United States Patent
Kim

(10) Patent No.: US 9,791,121 B2
(45) Date of Patent: Oct. 17, 2017

(54) VEHICLE LAMP

(71) Applicant: SL Corporation, Daegu (KR)

(72) Inventor: Yong-Hwan Kim, Gyeongbuk (KR)

(73) Assignee: SL Corporation, Daegu (KR)

( * ) Notice: Subject to any disclaimer, the term of this patent is extended or adjusted under 35 U.S.C. 154(b) by 262 days.

(21) Appl. No.: 14/481,091

(22) Filed: Sep. 9, 2014

(65) Prior Publication Data

US 2015/0070920 A1 Mar. 12, 2015

(30) Foreign Application Priority Data

Sep. 10, 2013 (KR) ..... 10-2013-0108498
Nov. 5, 2013 (KR) ..... 10-2013-0133265

(51) Int. Cl.
*F21V 7/04* (2006.01)
*F21S 8/10* (2006.01)
*F21W 101/10* (2006.01)

(52) U.S. Cl.
CPC ..... *F21S 48/1305* (2013.01); *F21S 48/1104* (2013.01); *F21S 48/1159* (2013.01); *F21S 48/12* (2013.01); *F21S 48/1216* (2013.01); *F21S 48/13* (2013.01); *F21S 48/142* (2013.01); *F21S 48/30* (2013.01); *F21S 48/321* (2013.01); *F21S 48/328* (2013.01); *F21W 2101/10* (2013.01)

(58) Field of Classification Search
CPC .. F21S 48/1104; F21S 48/1109; F21S 48/115; F21S 48/1159; F21S 48/12; F21S 48/1216; F21S 48/13; F21S 48/1305; F21S 48/1311; F21S 48/142; F21S 48/30; F21S 48/321; F21S 48/328
USPC ..... 362/507, 516–522, 538–539, 543–549
See application file for complete search history.

(56) References Cited

U.S. PATENT DOCUMENTS 7,441,933 B2 * 10/2008 Tsukamoto ..... F21S 48/1109 362/545
7,535,727 B2 * 5/2009 Tokida ..... F21S 48/1109 174/255

FOREIGN PATENT DOCUMENTS

JP 2012-119261 A 6/2012
JP 2012119260 A 6/2012
JP 2013-045688 A 3/2013
KR 101092693 B1 12/2011

* cited by examiner

*Primary Examiner* — Jason Moon Han
(74) *Attorney, Agent, or Firm* — Mintz Levin Cohn Ferris Glovsky and Popeo, P.C.; Kongsik Kim; Colleen H. Witherell

(57) ABSTRACT

A lamp for a vehicle comprises a lens disposed on an optical axis, a light source disposed at a rear of a focal point of the lens, a reflector configured to reflect light emitted from the light source forward, a supporting plate configured to be coupled to a lower part of the reflector, a first coupling unit configured to couple the supporting plate and the reflector from a front of the supporting plate and the reflector, and a second coupling unit configured to couple the supporting plate and the reflector from a rear of the supporting plate and the reflector. The first coupling unit and the second coupling unit have different coupling surfaces from each other.

13 Claims, 27 Drawing Sheets

VEHICLE LAMP

CROSS-REFERENCE TO RELATED APPLICATION

This application claims priority to Korean Patent Application No. 10-2013-0108498 filed on Sep. 10, 2013 and No. 10-2013-0133265 filed on Nov. 5, 2013, which applications are incorporated herein by reference.

TECHNICAL FIELD

The invention relates to a lamp for a vehicle, and more particularly, to a headlamp for a vehicle, which can improve the efficiency of a process for coupling components and related parts of a lamp unit or module (e.g., headlamp unit or module) such as a supporting plate, a reflector, a heat sink and a connector.

BACKGROUND ART

Vehicles are typically equipped with various automotive lamps having a lighting function and a signaling function, among others. That is, automotive lamps enable the driver of a vehicle to easily detect objects around the vehicle while driving at night, and also inform other vehicles and road users of the vehicle's driving state.

For example, there are automotive vehicle lamps that directly emit light with the use of a light source, such as headlamps for emitting light forward to secure the field of vision for the drivers, break lamps turned on or off in response to the brake pedal being pressed, and turn signal lights for signaling a right turn or a left turn, and reflectors for reflecting light to allow the vehicle to be easily recognizable. Recently, halogen lamps or high-intensity discharge (HID) lamps have been used as light sources for automotive lamps. Additionally, light-emitting diodes (LEDs) have been used as light sources as well.

Thus far, automotive lamps (e.g., headlamps) either have a structure in which a supporting plate for supporting a lens holder and a reflector and a heat sink are coupled by screws, or need a complicated assembly processes. As a result, the number of parts is quite high and assembly processes is quite long, thereby causing the overall assembly process to be long and inconvenient.

SUMMARY

According to an exemplary embodiment of the invention, a lamp for a vehicle comprises a lens, a light source, a reflector, a supporting plate, a first coupling unit, and a second coupling unit. The lens is disposed on an optical axis extending in a longitudinal direction of the vehicle. The light source is disposed at a rear of a focal point of the lens. The reflector reflects light emitted from the light source forward. The supporting plate is configured to be coupled to a lower part of the reflector. The first coupling unit is configured to couple the supporting plate and the reflector from a front of the supporting plate and the reflector. The second coupling unit is configured to couple the supporting plate and the reflector from a rear of the supporting plate and the reflector. The first coupling unit and the second coupling unit provide different coupling surfaces from each other.

Other features and exemplary embodiments will be apparent from the following detailed description, the drawings, and the claims.

DETAILED DESCRIPTION OF THE EMBODIMENTS

Figure 1:
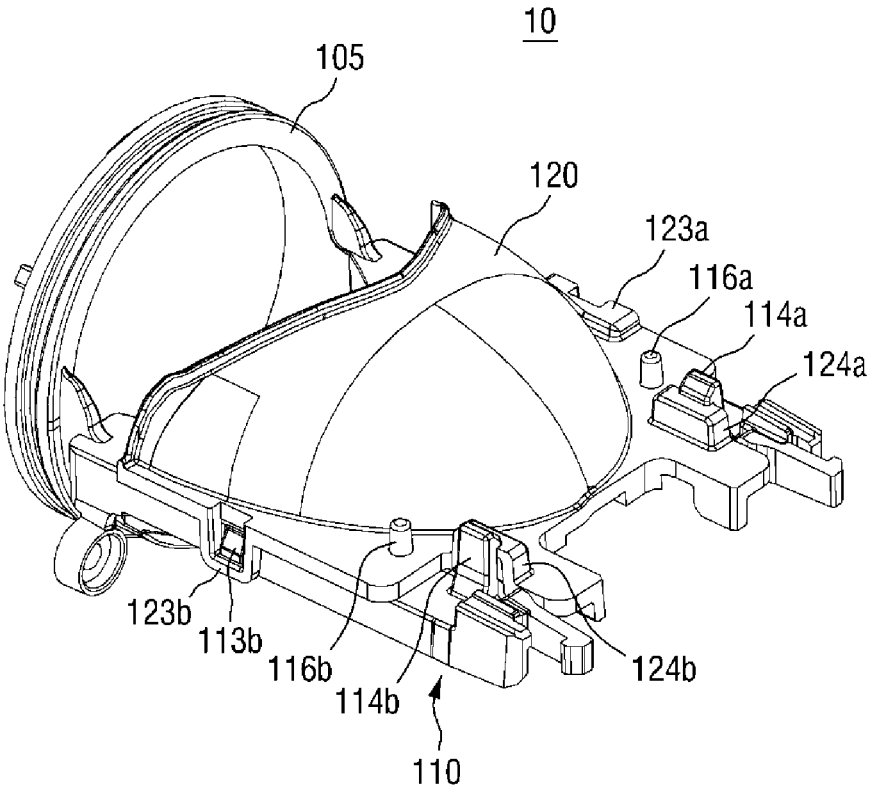
FIG. 1 is an exemplary assembled perspective view of a lens holder, a supporting plate and a reflector of a vehicle headlamp according to an exemplary embodiment of the invention.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Like reference numerals refer to like elements throughout the specification.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Hereinafter, vehicle lamps of the present invention will be described in detail with embodiments of the present invention and with reference to the accompanying drawings in which vehicle headlamps are illustrated.

Figure 2:
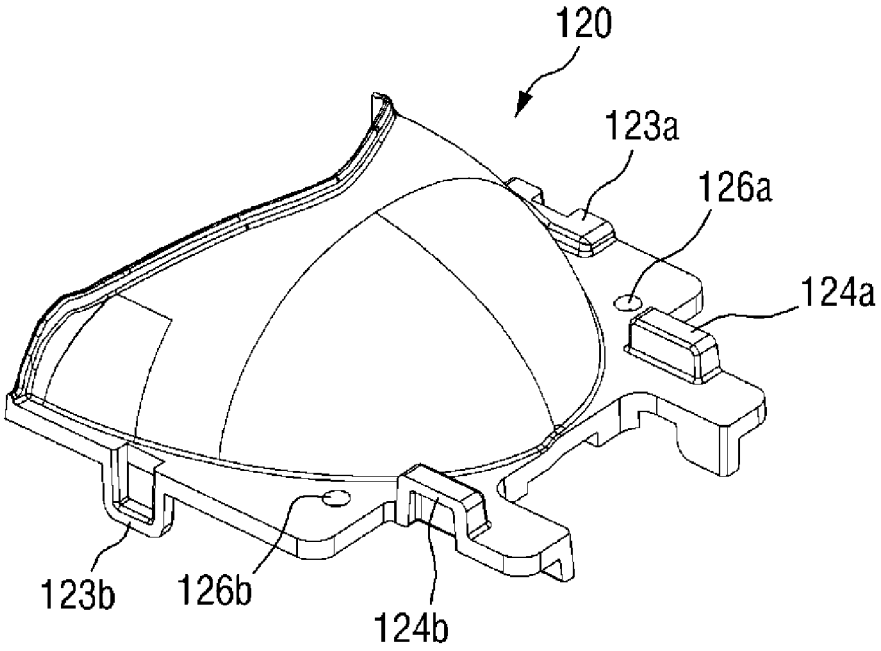
FIG. 2 is an exemplary perspective view of the reflector of the headlamp of FIG. 1.
Figure 3:
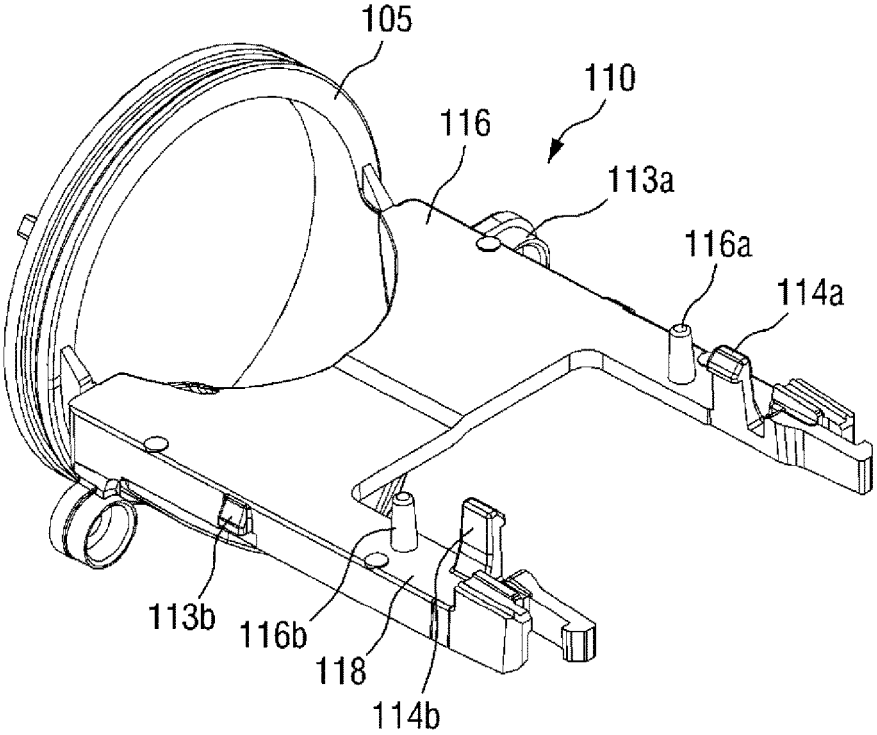
FIG. 3 is an exemplary assembled perspective view of the lens holder and the supporting plate of the headlamp of FIG. 1.

FIG. 1 is an exemplary assembled perspective view of a lens holder, a supporting plate and a reflector of a vehicle headlamp according to an exemplary embodiment of the invention, FIG. 2 is an exemplary perspective view of the reflector of the headlamp, and FIG. 3 is an exemplary assembled perspective view of the lens holder and the supporting plate of the headlamp. Referring to FIGS. 1 to 3, a headlamp 10 for a vehicle according to an embodiment of the invention includes a lens (not illustrated) disposed on an optical axis extending in a longitudinal direction of the vehicle, a light source (not illustrated) disposed at a position behind the focal point of the lens, a reflector 120 for reflecting forward light emitted from the light source, a supporting plate 110 coupled to a lower part of the reflector 120, a first coupling unit (113*a*, 113*b*, 123*a*, and 123*b*) for coupling the supporting plate 110 and the reflector 120 from the front of the supporting plate 110 and the reflector 120, and a second coupling unit (114*a*, 114*b*, 124*a*, and 124*b*) for coupling the supporting plate 110 and the reflector 120 from the rear of the supporting plate 110 and the reflector 120. Preferably, the coupling surface of the first coupling unit (113*a*, 113*b*, 123*a*, and 123*b*) may be formed to be different from that of the second coupling unit (114*a*, 114*b*, 124*a*, and 124*b*), as explained below.

If desired, one of the first coupling unit (113*a*, 113*b*, 123*a*, and 123*b*) and the second coupling unit (114*a*, 114*b*, 124*a*, and 124*b*) may be coupled to a side portion of the supporting plate 110, and the other coupling unit may be coupled to a top portion or a bottom portion of the supporting plate 110.

The coupling surface of the first coupling unit (113*a*, 113*b*, 123*a*, and 123*b*) and the coupling surface of the second coupling unit (114*a*, 114*b*, 124*a*, and 124*b*) may be formed at the front and the rear, respectively, of the supporting plate 110. Alternatively, the coupling surface of the first coupling unit (113*a*, 113*b*, 123*a*, and 123*b*) and the coupling surface of the second coupling unit (114*a*, 114*b*, 124*a*, and 124*b*) may be formed at the side and the rear (or the front), respectively, of the supporting plate 110. With this, the headlamp 10 may become robust against the vibration of the vehicle.

The first coupling unit (113*a*, 113*b*, 123*a*, and 123*b*) includes first hooks 123*a* and 123*b* disposed at one of the supporting plate 110 and the reflector 120 and first engaging members 113*a* and 113*b* disposed at the other of the supporting plate 110 and the reflector 120. The second coupling unit (114*a*, 114*b*, 124*a*, and 124*b*) includes second hooks 114*a* and 114*b* disposed at one of the supporting plate 110 and the reflector 120 and second engaging members 124*a* and 124*b* disposed at the other of the supporting plate 110 and the reflector 120. The first hooks 123*a* and 123*b* may be coupled to the first engaging members 113*a* and 113*b*, respectively, through snap fitting, and the second hooks 114*a* and 114*b* may be coupled to the second engaging members 124*a* and 124*b*, respectively, through snap fitting.

The first engaging members 113*a* and 113*b* and the second engaging members 124*a* and 124*b* may be, but not limited to, engaging holes 123*a*, 123*b* or engaging protrusions 124*a*, 124*b* with guide grooves. The engaging holes 123*a*, 123*b* may include through holes that are open toward the side(s) of the supporting plate 110, and the engaging protrusions 124*a*, 124*b* may include a recess formed to face the side(s) of the supporting plate 110 and an opening formed on the bottom thereof.

In an exemplary embodiment, four hooks, i.e., the first hooks 123*a* and 123*b* and the second hooks 114*a* and 114*b*, may be coupled to two engaging holes, i.e., the first engaging members 113*a* and 113*b*, and two engaging protrusions, i.e., the second engaging members 124*a* and 124*b*, through snap fitting. Accordingly, a robust design of the headlamp 10 may be possible for counteracting vibration and shock applied to the headlamp 10.

The term "coupling surface", as used herein, may indicate the contact surface between parts of a coupling unit that are coupled. For example, the coupling surface of the first coupling unit (113*a*, 113*b*, 123*a*, and 123*b*) may be the contact surfaces between the first hooks 123*a* and 123*b* and the first engaging members 113*a* and 113*b*. As discussed above, the coupling surface of the first coupling unit (113*a*, 113*b*, 123*a*, and 123*b*) may be formed to be different from that of the second coupling unit (114*a*, 114*b*, 124*a*, and 124*b*). For example, the coupling surfaces may be on different planes. That is, the coupling surface of the first coupling unit (113*a*, 113*b*, 123*a*, and 123*b*) and the coupling surface of the second coupling unit (114*a*, 114*b*, 124*a*, and 124*b*) may be provided on different planes. Also, for example, the coupling surfaces may have different coupling directions. As illustrated in FIG. 1, the coupling surface of the first coupling unit (113*a*, 113*b*, 123*a*, and 123*b*) may be provided on an inner lower side of each of the first engaging members 113*a* and 113*b*, and the coupling surface of the second coupling unit (114*a*, 114*b*, 124*a*, and 124*b*) may be provided at an upper side of each of the second engaging members 124*a* and 124*b*. That is, the coupling surface of the first coupling unit (113*a*, 113*b*, 123*a*, and 123*b*) may be in a downward direction, and the coupling surface of the second coupling unit (114*a*, 114*b*, 124*a*, and 124*b*) may be in an upward direction.

In an exemplary embodiment, as illustrated in FIGS. 1 to 3, the engaging holes 123*a*, 123*b* may be disposed on a side portion(s) of the supporting plate 110, and the engaging protrusions 124*a*, 124*b* may be disposed on a top portion(s) of the supporting plate 110. However, the invention is not limited to this exemplary embodiment. That is, for example, the engaging holes 123*a*, 123*b* may be provided on a top portion(s) of the supporting plate 110, and the engaging protrusions 124*a*, 124*b* may be provided on a side portion(s) of the supporting plate 110.

When the assembly of the headlamp 10 is completed, the barbs of the first hooks 123*a*, 123*b* may be located inside the engaging holes 123*a*, 123*b*, and the barbs of the second hooks 114 may be located at the top of the engaging protrusions 124*a*, 124*b*.

Location and number of coupling points may be selected appropriately. In an exemplary embodiment, as illustrated in FIG. 2, four effective locations for coupling the supporting plate 110 and the reflector 120, for example, two lateral locations and two rear locations, may be selected from the supporting plate 110 and the reflector 120. In this exemplary embodiment, the engaging holes 123*a*, 123*b* each having a through hole may be disposed at the two lateral locations, respectively, and the engaging protrusions 124*a*, 124*b* each having a recess and an opening may be disposed at the two rear locations, respectively.

Accordingly, an operator is supposed to couple the supporting plate 110 and the reflector 120 may easily complete the assembly of the headlamp 10 through snap fitting simply by pressing the reflector 120 down on the supporting plate 110.

In an alternative exemplary embodiment, the engaging holes 123*a*, 123*b* may be provided at the two rear locations, respectively, and the engaging protrusions 124*a*, 124*b* may be provided at the two lateral locations, respectively.

In another alternative exemplary embodiment, a plurality of hooks may be provided at the reflector 120, and a plurality of holes and a plurality of engaging protrusions may be provided at the supporting plate 110.

The supporting plate 110 may also include a shield unit 116 and extension unit 118 extending rearwardly from the shield unit 116. The shield unit 116 functions to form a cutoff line in a light distribution pattern by blocking at least a portion of the light reflected from the reflector 120.

The supporting plate 110 may include a plurality of guide ribs 117, which extend from the top surface of the supporting plate 110 and guide the coupling of the supporting plate 110 and the reflector 120, and the reflector 120 may include a plurality of guide couplers 126, which correspond to the guide ribs 116, respectively.

The guide ribs 116 for guiding the coupling between the supporting plate 110 and the reflector 120 may be disposed in the shield unit 116 or in the extension unit 118.

The reflector 120 may also include a plurality of guide couplers 126*a* and 126*b* into which a plurality of guide ribs 116*a* and 116*b* may be inserted, respectively.

Before the snap-fit coupling of the first hooks 123*a* and 123*b* and the first engaging members 113*a* and 113*b* and the snap-fit coupling of the second hooks 114*a* and 114*b* and the second engaging members 124*a* and 124*b*, the guide ribs 116 may be inserted into the guide couplers 126, respectively so as to guide the coupling of the supporting plate 110 and the reflector 120. Accordingly, it is possible to improve the convenience of the assembly of the headlamp 10 while adequately manipulating the supporting plate 110 and the reflector 120.

Figure 4:
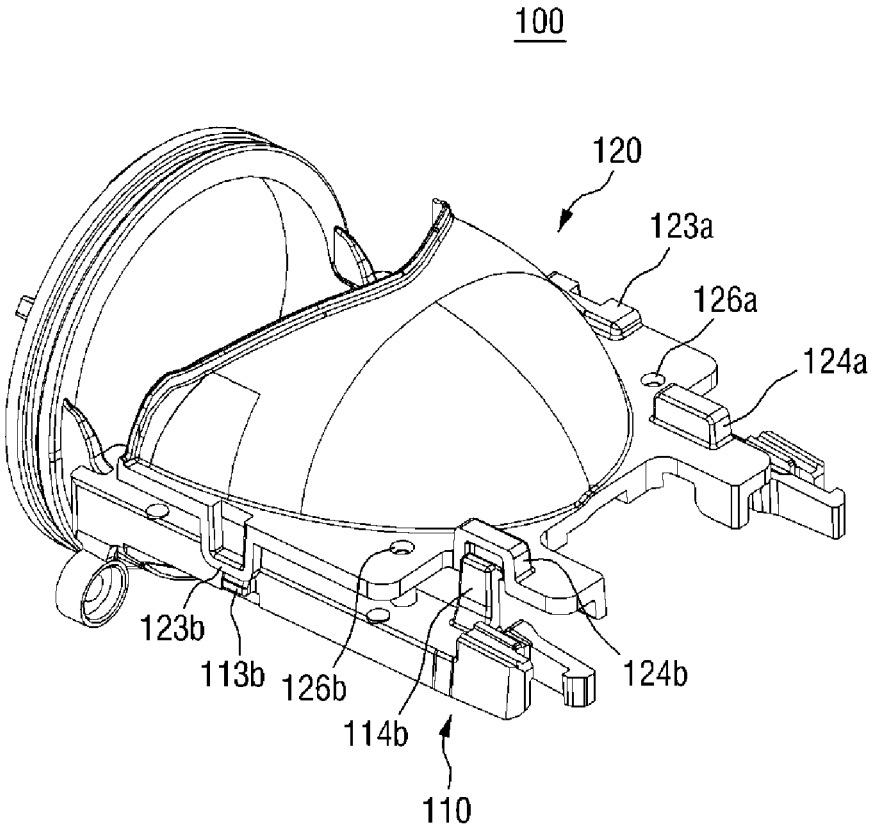
FIG. 4 is an exemplary perspective view of the lens holder, the supporting plate and the reflector, in a temporarily assembled state, of the headlamp of FIG. 1.

FIG. 4 is an exemplary perspective view of the lens holder, the supporting plate and the reflector, in a temporarily assembled state, of the headlamp of FIG. 1. Referring to FIGS. 1 to 4, the first hooks 123*a* and 123*b* and the second hooks 114*a* and 114*b* are coupled to the first engaging members 113*a* and 113*b* and the second engaging members 124*a* and 124*b*, respectively, through snap fitting, and at least one of the hooks may be coupled in a different direction from the rest of the hooks. For example, the barb(s) of at least one of the hooks may face toward the outside of the supporting plate 110, and the barbs of the other hooks may face toward the inside of the supporting plate 110. If one or more of hooks are coupled in a different directions) from the rest of the hooks, the headlamp 10 may become more robust against vibration and shock than when all the hooks are all coupled in the same direction. Accordingly, the stability of the coupling of the supporting plate 110 and the reflector 120 (particularly, the prevention of lateral movement) may be ensured. The temporary assembled state of the supporting plate 110 and the reflector 120 may be maintained, if necessary, which is beneficial for a later coupling of the supporting plate 110 and the reflector 120, as illustrated in FIG. 4.

The temporary assembled state of the supporting plate 110 and the reflector 120 is not a state in which the supporting plate 110 and the reflector 120 are completely coupled together, but a state in which the supporting plate 110 and the reflector 120 are ready to be assembled together simply by applying force from thereabove. Accordingly, the temporary assembled state may improve the assembly process.

Figure 5:
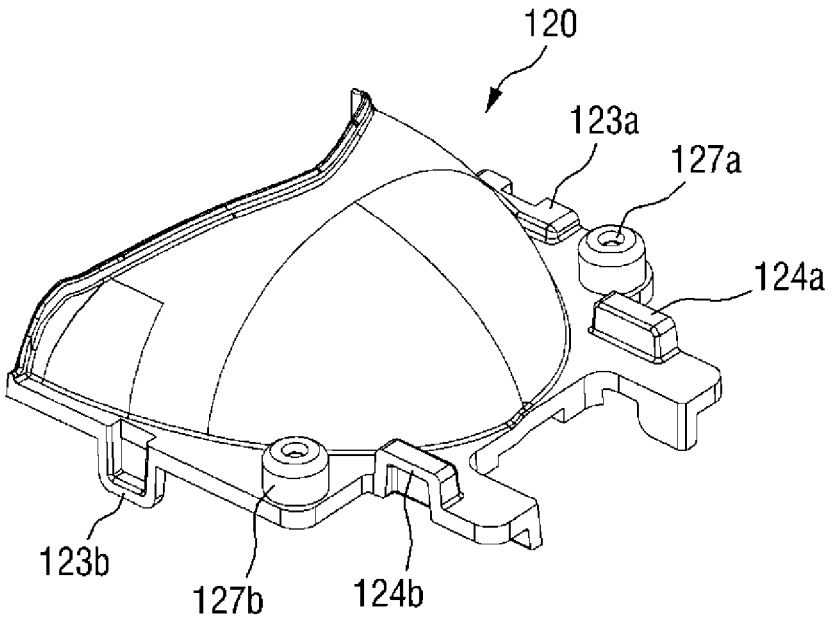
FIG. 5 is another exemplary perspective view of the reflector of the headlamp of FIG. 1.
Figure 6:
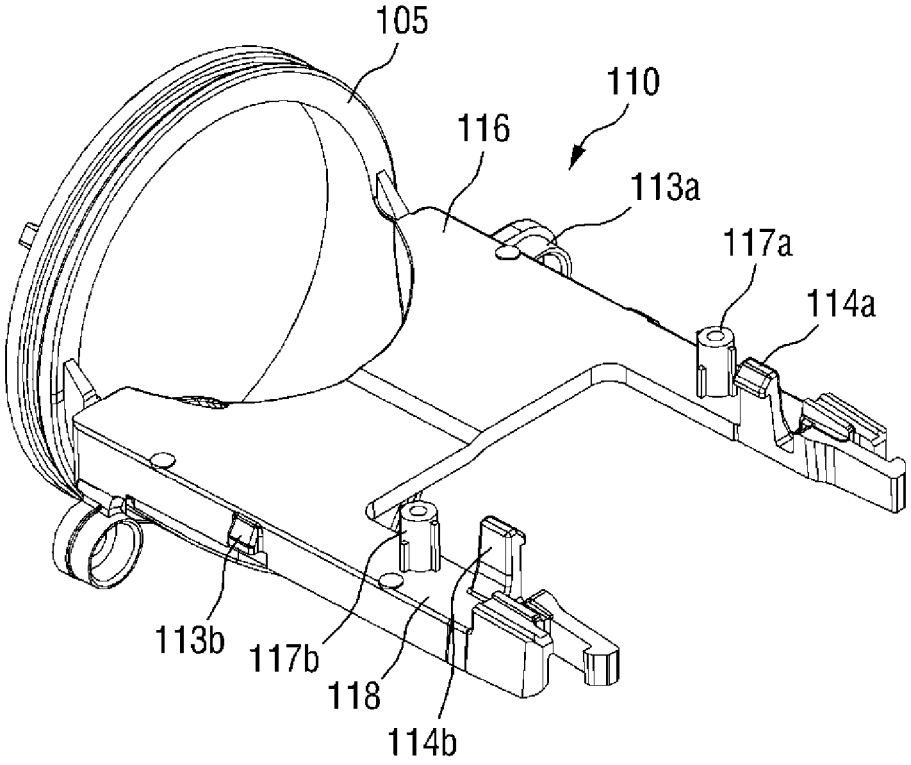
FIG. 6 is another exemplary assembled perspective view of the lens holder and the supporting plate of the headlamp of FIG. 1.

FIG. 5 is another perspective view of the reflector of the headlamp of FIG. 1, and FIG. 6 is another exemplary assembled perspective view of the lens holder and the supporting plate of the headlamp. Referring to FIGS. 5 and 6, a plurality of guide ribs 117 and a plurality of guide couplers 127 each may include a hole therein. The guide ribs 117 may be coupled to the guide couplers 127, respectively, through bolting. Accordingly, the guide ribs 117 and the guide couplers 127 not only can provide guidance, but also can improve the coupling between the supporting plate 110 and the reflector 120. Nearly all types of bolting shapes and methods may be used to couple the guide ribs 117 to the guide couplers 127, respectively, as long as they can improve the coupling between the supporting plate 110 and the reflector 120.

Figure 7:
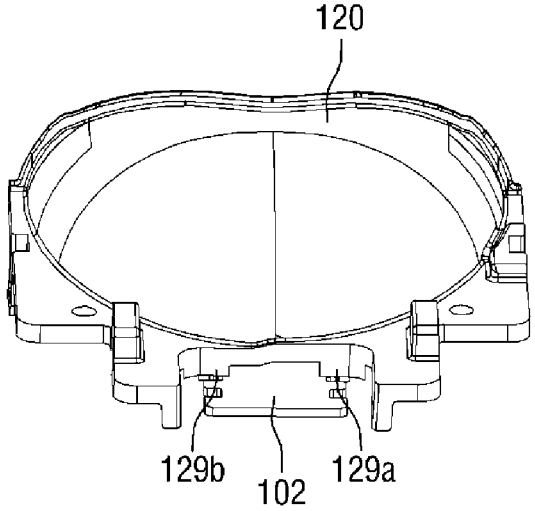
FIG. 7 is another exemplary perspective view of the reflector of the headlamp of FIG. 1.

FIG. 7 is another perspective view of the reflector of the headlamp of FIG. 1. Referring to FIGS. 1 to 7, the reflector 120 includes a plurality of light source supporting ribs 129*a* and 129*b* for limiting the movement of a light source (not illustrated). More specifically, the light source supporting ribs 129*a* and 129*b* may limit the movement of the light source by pressing a light source unit 102 where the light source is provided. In an exemplary embodiment, the reflector 120 may have two light source supporting ribs, i.e., the light source supporting ribs 129*a* and 129*b*, as illustrated in FIG. 7, but there are no restrictions on the number and locations of light supporting ribs as long as the light supporting ribs can adequately limit the movement of the light source.

Figure 8:
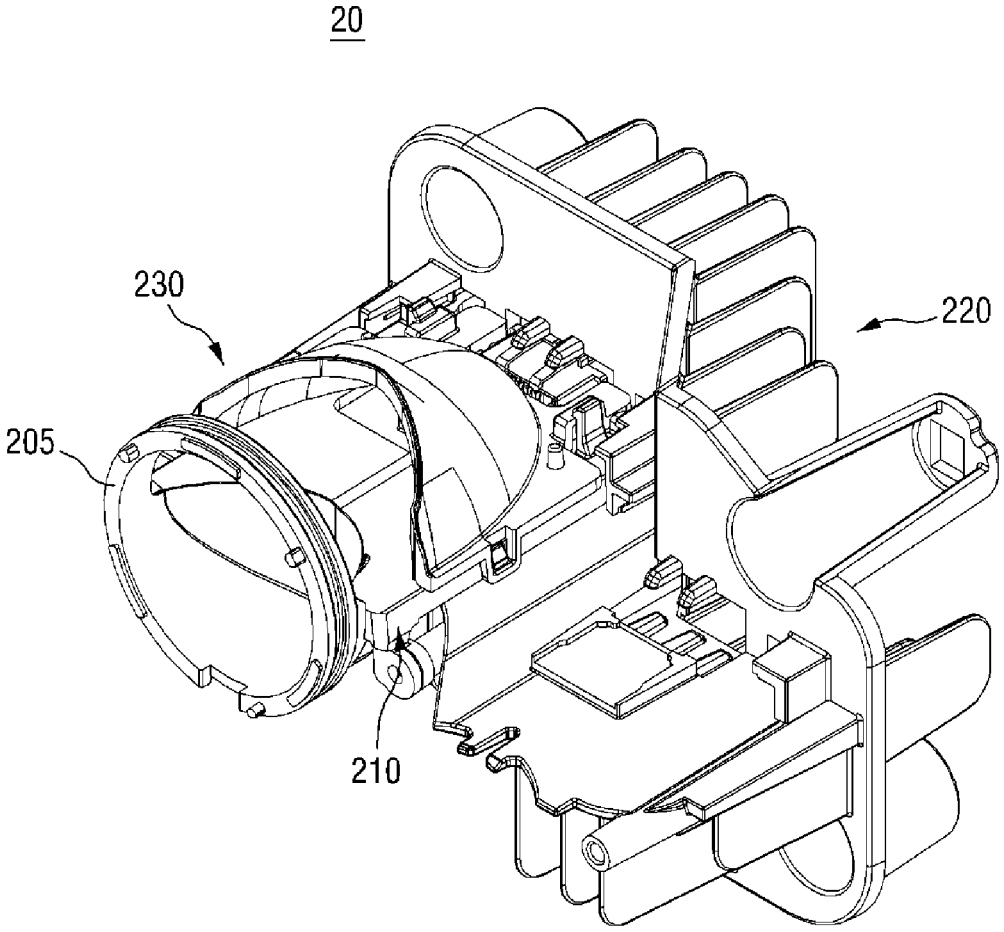
FIG. 8 is an exemplary assembled perspective view of a lens holder, a supporting plate, a reflector, a connector, and a heat sink of a vehicle headlamp according to another exemplary embodiment of the invention.
Figure 9:
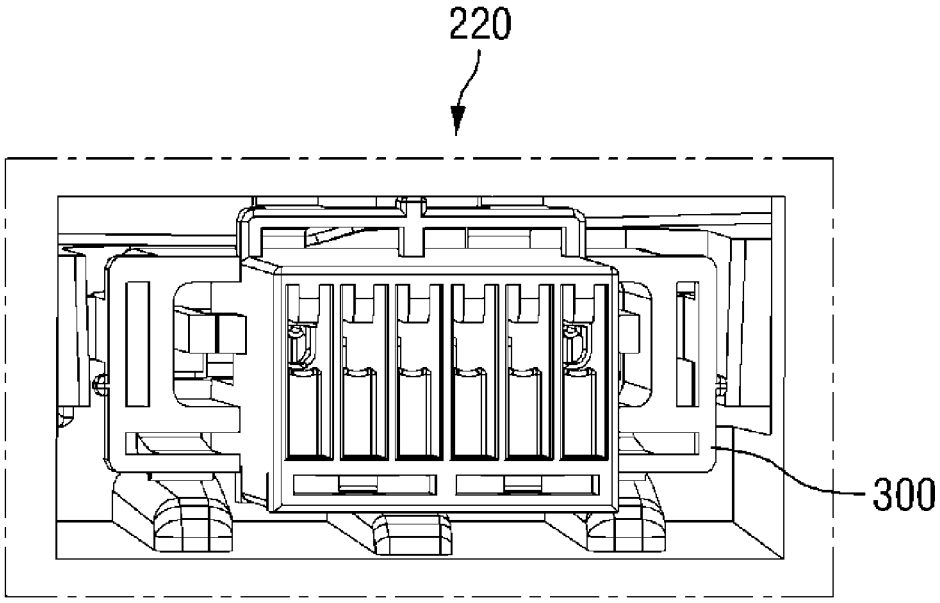
FIG. 9 is an exemplary assembled perspective view of the heat sink and the connector of the headlamp of FIG. 8.
Figure 10:
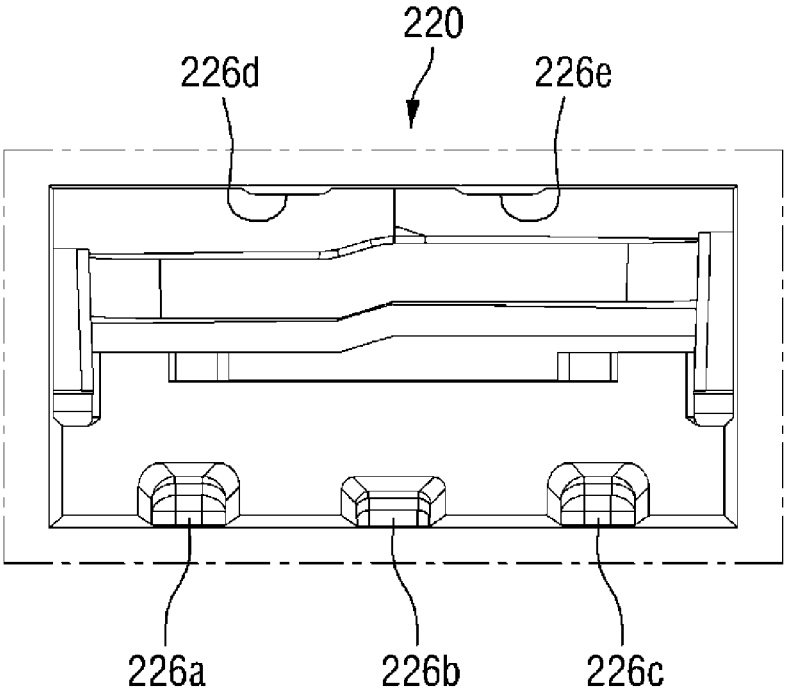
FIG. 10 is an exemplary bottom view of a through hole in the heat sink of the headlamp of FIG. 8.
Figure 11:
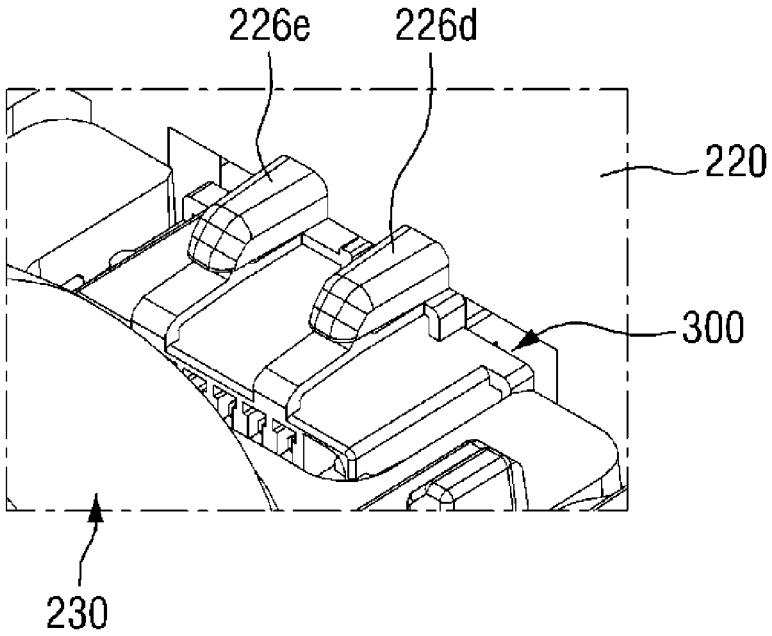
FIG. 11 is an exemplary assembled perspective view of the connector, the heat sink and the reflector of the headlamp of FIG. 8.
Figure 12:
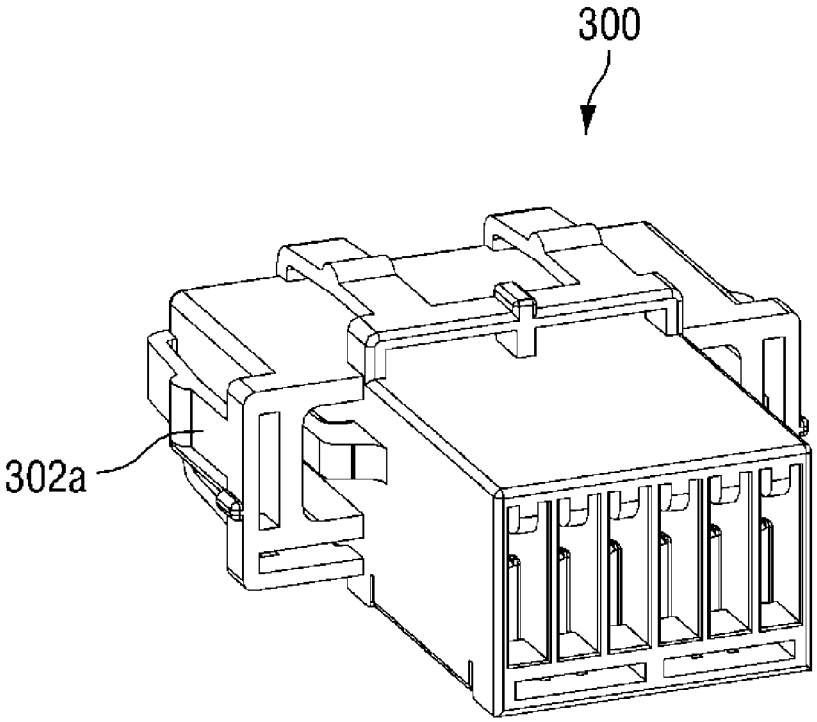
FIG. 12 is an exemplary perspective view of the connector of the headlamp of FIG. 8.

FIG. 8 is an exemplary assembled perspective view of a lens holder, a supporting plate, a reflector, a connector, and a heat sink of a headlamp for a vehicle according to another exemplary embodiment of the invention, FIG. 9 is an exemplary assembled perspective view of the heat sink and the connector of the headlamp, FIG. 10 is an exemplary bottom view of a through hole in the heat sink of the headlamp, FIG. 11 is an exemplary assembled perspective view of the connector, the heat sink and the reflector of the headlamp, and FIG. 12 is an exemplary perspective view of the connector of the headlamp. Referring to FIGS. 8 to 12, a headlamp 20 for a vehicle includes a lens (not illustrated) disposed on an optical axis extending in a longitudinal direction of the vehicle, a light source (not illustrated) disposed at the rear of the focal point of the lens, a reflector 230 for reflecting light emitted from the light source forward, a supporting plate 210 coupled to a lower part of the reflector 120, a heat sink 220 coupled to the rear of the supporting plate 210 for dissipating heat generated by the light source, and a connector 300 for applying a current to the light source. The heat sink 220 includes a through hole in which the connector 300 is to be inserted and a plurality of first movement-limiting ribs 226*a*, 226*b*, 226*c*, 226*d*, and 226*e* for fixing the connector to the vicinity of the through hole.

The connector 300 is electrically coupled to the light source through the through hole of the heat sink 220, and the first movement-limiting ribs 226*a*, 226*b*, 226*c*, 226*d*, and 226*e* limit the movement of the connector 300 by pressing the connector 300. The front end of the connector 300 may be coupled to a terminal (not illustrated) electrically connected to the light source, and the rear end of the connector 300 may be coupled to a cable electrically connected to an electronic control system (not illustrated) of the vehicle.

The first movement-limiting ribs 226*b*, 226*c*, 226*d*, and 226*e* may be formed on at least one of an inner circumferential surface of the through hole and the edge of the through hole, and may extend in a direction parallel to the optical axis to limit the movement of the connector 300.

Also, as illustrated in FIGS. 10 and 11, the first movement-limiting ribs 226*b*, 226*c*, 226*d*, and 226*e* may be formed at both the top and the bottom of the through hole along the direction parallel to the optical axis to limit the vertical movement of the connector 300.

However, there are no restrictions on the direction and location in which to form the first movement-limiting ribs 226*b*, 226*c*, 226*d*, and 226*e* as long as the first movement-limiting ribs 226*c*, 226*d*, and 226*e* can adequately limit the movement of the connector 300.

Figure 13:
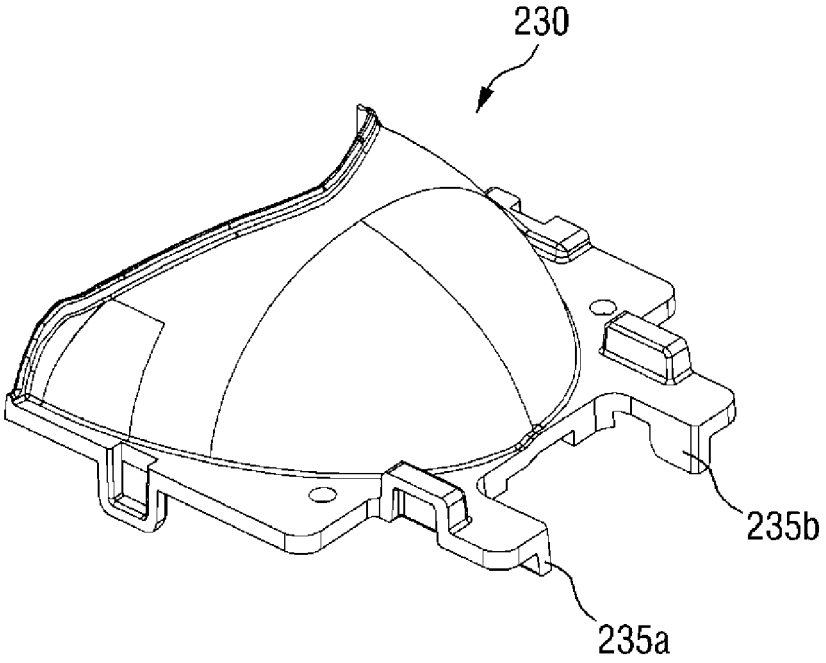
FIG. 13 is an exemplary perspective view of the reflector of the headlamp of FIG. 8.
Figure 14:
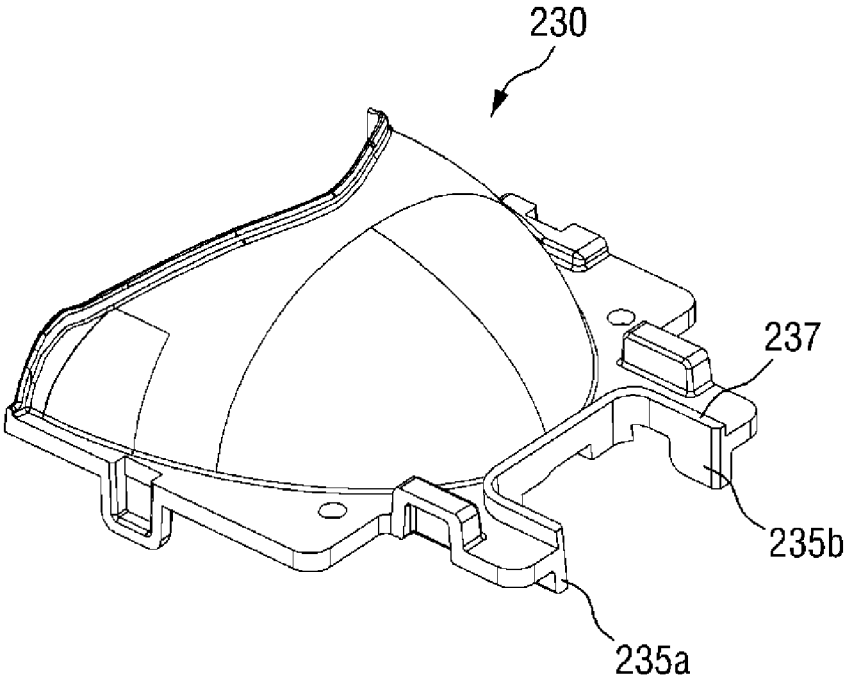
FIG. 14 is another exemplary perspective view of the reflector of the headlamp of FIG. 8.
Figure 15:
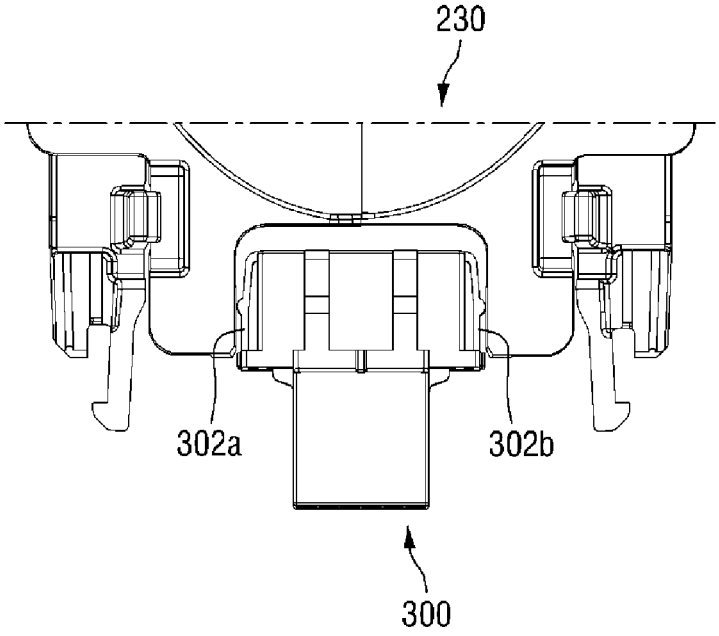
FIG. 15 is an exemplary assembled plan view of the connector, the reflector and the supporting plate of the headlamp of FIG. 8.

FIGS. 13 and 14 are exemplary perspective views of the reflector of the headlamp of FIG. 8, and FIG. 15 is an exemplary assembled plan view of the connector, the reflector and the supporting plate of the headlamp. Referring to FIGS. 13 to 15, the reflector 230 includes a fixing groove for coupling the connector 300 to the rear of the reflector 230. The reflector 230 may include a plurality of second movement-limiting ribs 235*a* and 235*b*, which are formed near the fixing groove as extensions and limit the movement of the connector 300. The second movement-limiting ribs 235*a* and 235*b* fix a plurality of projecting ribs 302*a* and 302*b*, respectively, which protrude from the left and right sides of the connector 300.

The second movement-limiting ribs 235*a* and 235*b* may be formed to extend upwardly or downwardly from the reflector 230.

Accordingly, no additional screw coupling is needed, and both the assembly of the headlamp 20 and the stability of the coupling of the reflector 230 and the connector 300 may be improved.

As illustrated in FIG. 14, the reflector 230 may also include a reinforcing rib 237 formed on the outer circumferential surface of the fixing groove. The reinforcing rib 237 may be on an opposite side of the reflector 230 to the second movement-limiting ribs 235*a* and 235*b*, but the invention is not limited thereto. Due to the presence of the reinforcing rib 237, the stability of the coupling of the reflector 230 and the connector 300 may be further improved.

Figure 16:
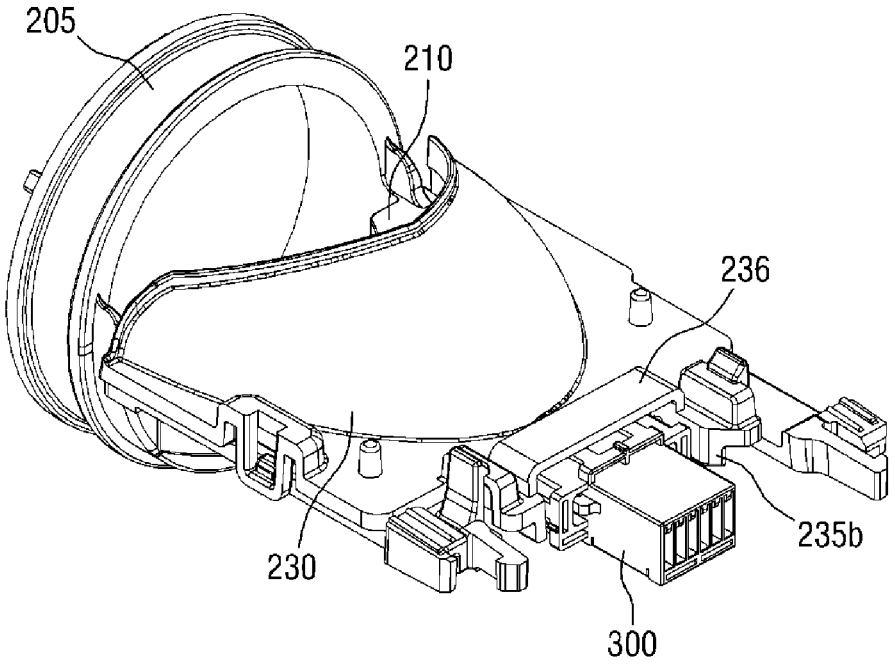
FIG. 16 is an exemplary assembled perspective view of the connector, the reflector and the supporting plate of the headlamp of FIG. 8.
Figure 17:
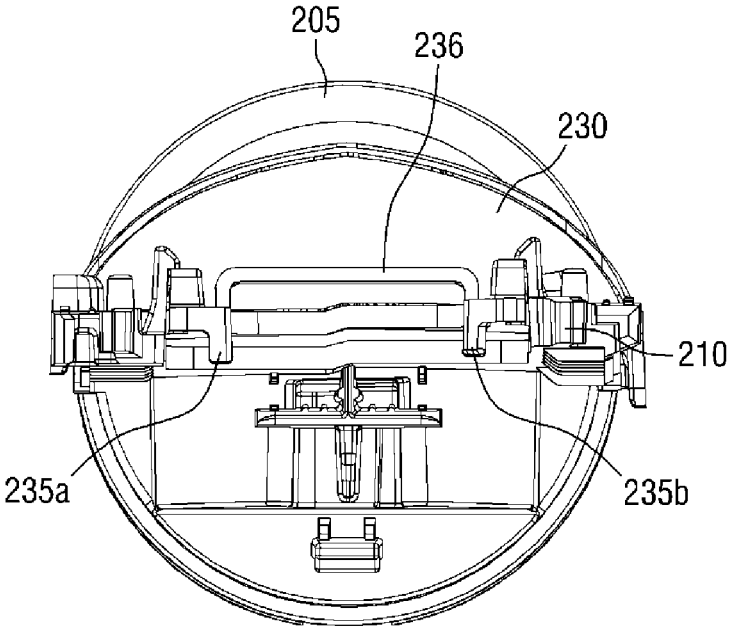
FIG. 17 is an exemplary assembled bottom view of the reflector and the supporting plate of the headlamp of FIG. 8.

FIG. 16 is an exemplary assembled perspective view of the connector, the reflector and the supporting plate of the headlamp of FIG. 8, and FIG. 17 is an assembled bottom view of the reflector and the supporting plate of the headlamp. Referring to FIGS. 12 to 17, the headlamp 20 includes the lens (not illustrated) disposed on an optical axis extending in the longitudinal direction of the vehicle, the light source (not illustrated) disposed at the rear of the focal point of the lens, the reflector 230 for reflecting light emitted from the light source forward, the supporting plate 210 coupled to a lower part of the reflector 120, the heat sink 220 coupled to the rear of the supporting plate 210 for dissipating heat generated by the light source, and the connector 300 for applying a current to the light source. The heat sink 220 includes a through hole in which the connector 300 is inserted, and the reflector 230 includes a plurality of third movement-limiting ribs 236 extending from the rear of the reflector 230 for preventing the movement of the connector 300.

Unlike the first movement-limiting ribs 226*a*, 226*b*, 226*c*, 226*d*, and 226*e* provided on the heat sink 220, the third movement-limiting ribs 236 provided on the reflector 230 and may limit the movement of the connector 300.

The reflector 230 may include a fixing groove for coupling the connector 300 to the rear of the reflector 230. The reflector 230 may include the second movement-limiting ribs 235*a* and 235*b*, which are formed near the fixing groove as extensions and limit the movement of the connector 300. The connector 300 may include the projecting ribs 302*a* and 302*b*, which protrude from the outer circumferential surface of the connector 300 and are placed in contact with the second movement-limiting ribs 235*a* and 235*b*, respectively.

The second movement-limiting ribs 235*a* and 235*b* may fix the projecting ribs 302*a* and 302*b*, respectively, which protrude from the left and right sides of the connector 300, and may thus improve the coupling of the connector 300 and the reflector 230 while properly limiting the movement of the connector 300.

The third movement-limiting ribs 236 may be formed to extend from both ends of the fixing groove, and the second movement-limiting ribs 235*a* and 235*b* may be formed to extend upwardly or downwardly from the reflector 230.

Figure 18:
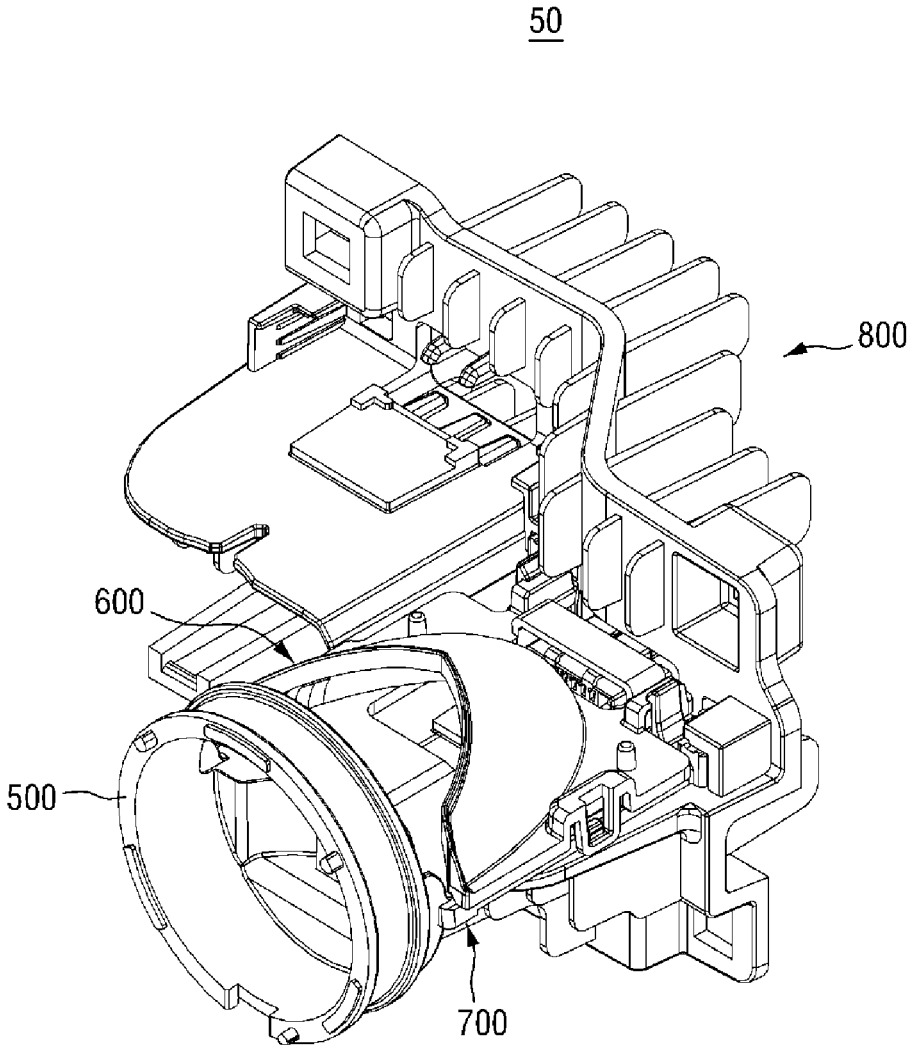
FIG. 18 is an exemplary perspective view of a vehicle headlamp according to still another exemplary embodiment of the invention.
Figure 19:
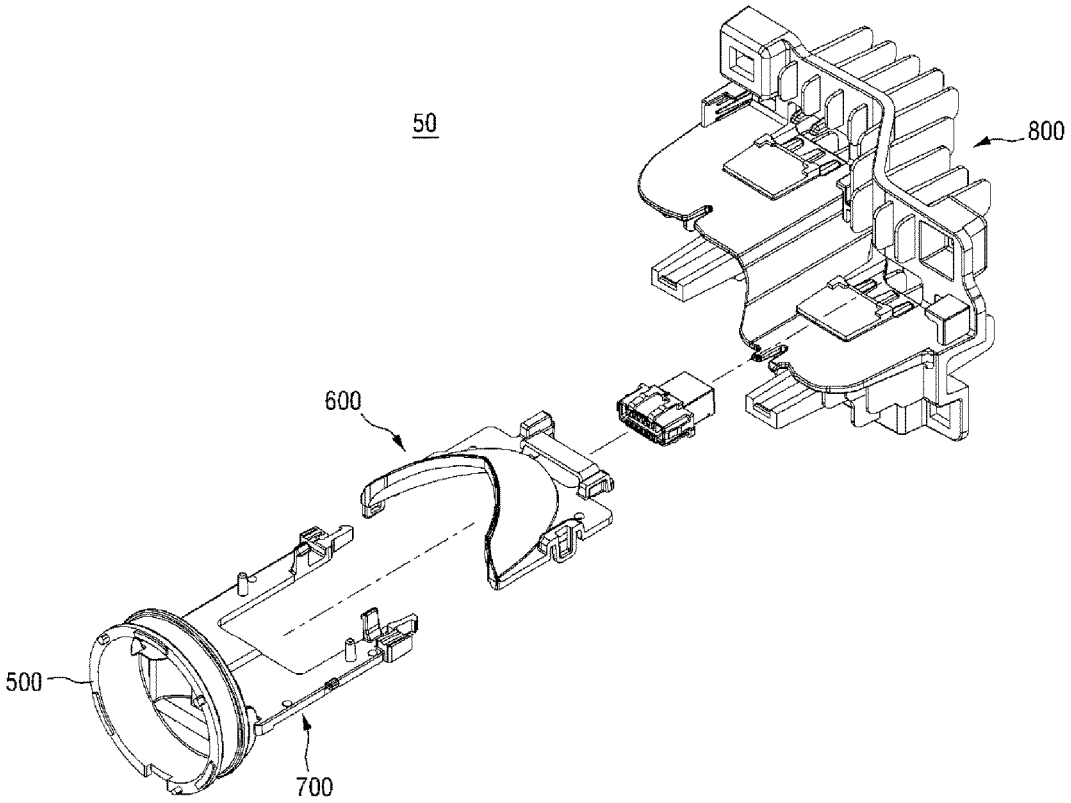
FIG. 19 is an exemplary exploded perspective view of the headlamp of FIG. 18.
Figure 20:
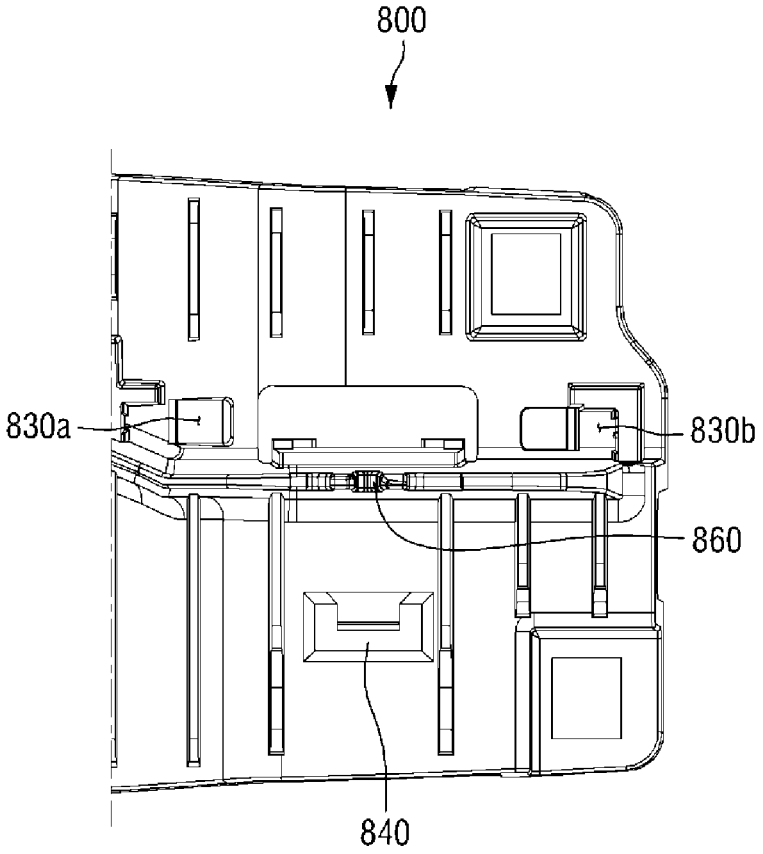
FIG. 20 is an exemplary partial view of a heat sink of the headlamp of FIG. 18.
Figure 21:
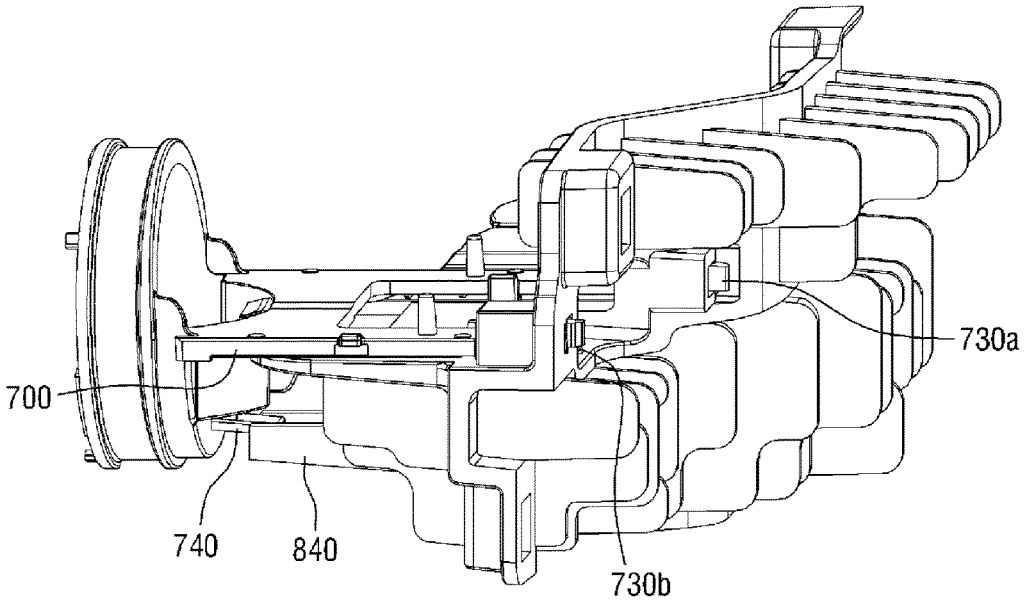
FIG. 21 is an exemplary front view of the heat sink of the headlamp of FIG. 18.
Figure 22:
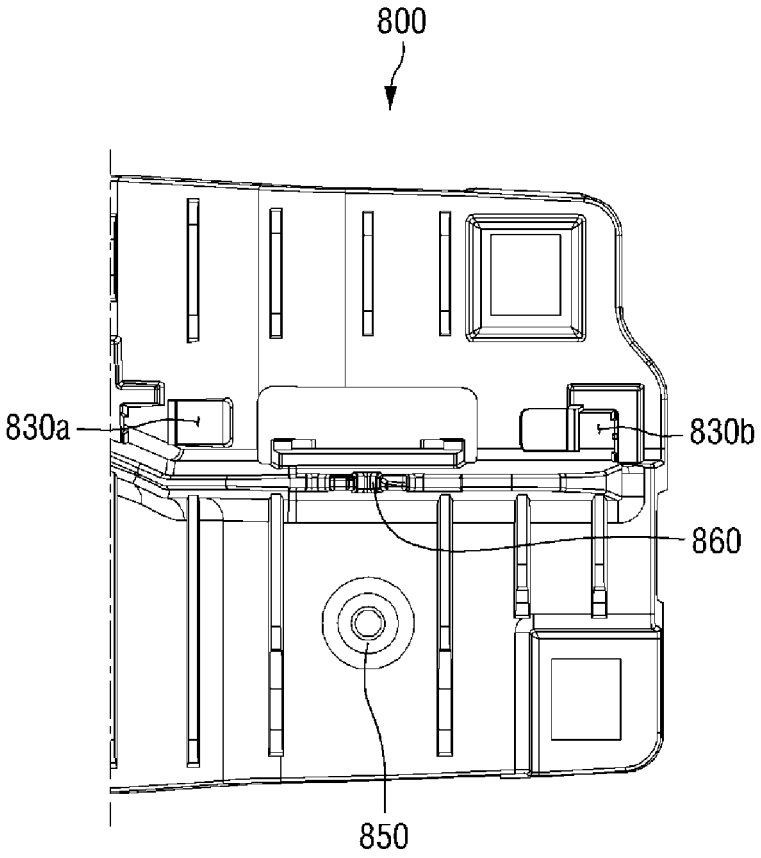
FIG. 22 is an exemplary assembled view of a supporting plate and the heat sink of the headlamp of FIG. 18.
Figure 23:
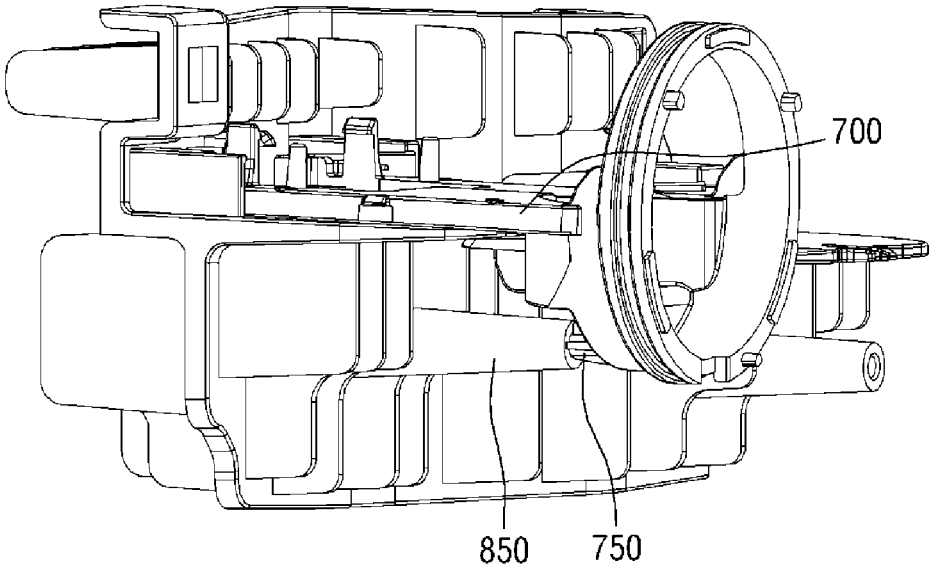
FIG. 23 is another exemplary front view of the heat sink of the headlamp of FIG. 18.
Figure 24:
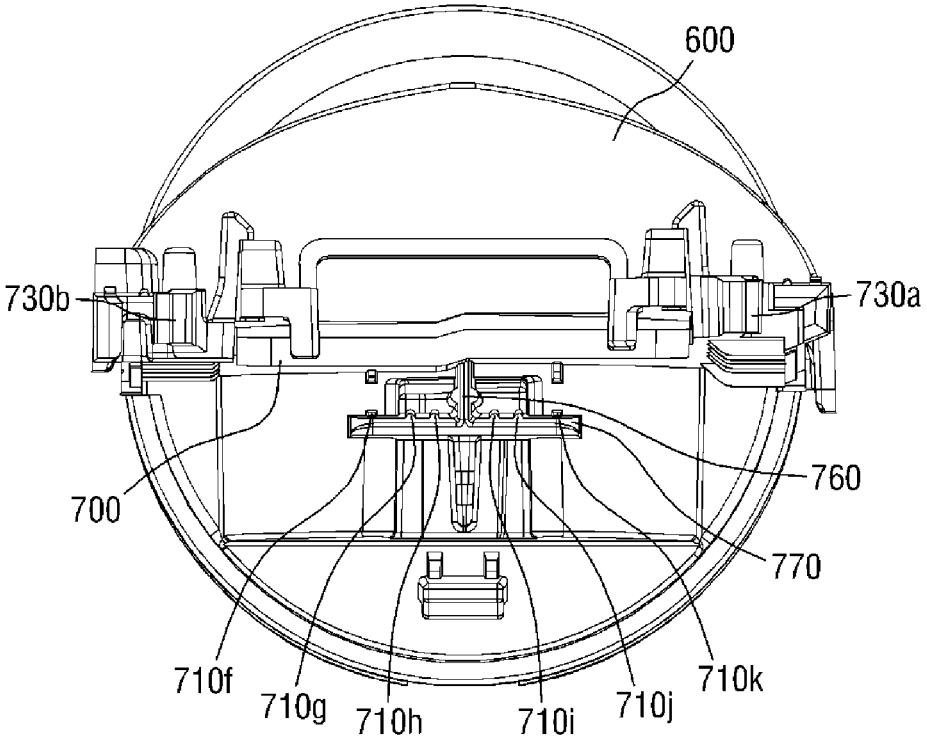
FIG. 24 is another exemplary assembled view of the supporting plate and the heat sink of the headlamp of FIG. 18.
Figure 25:
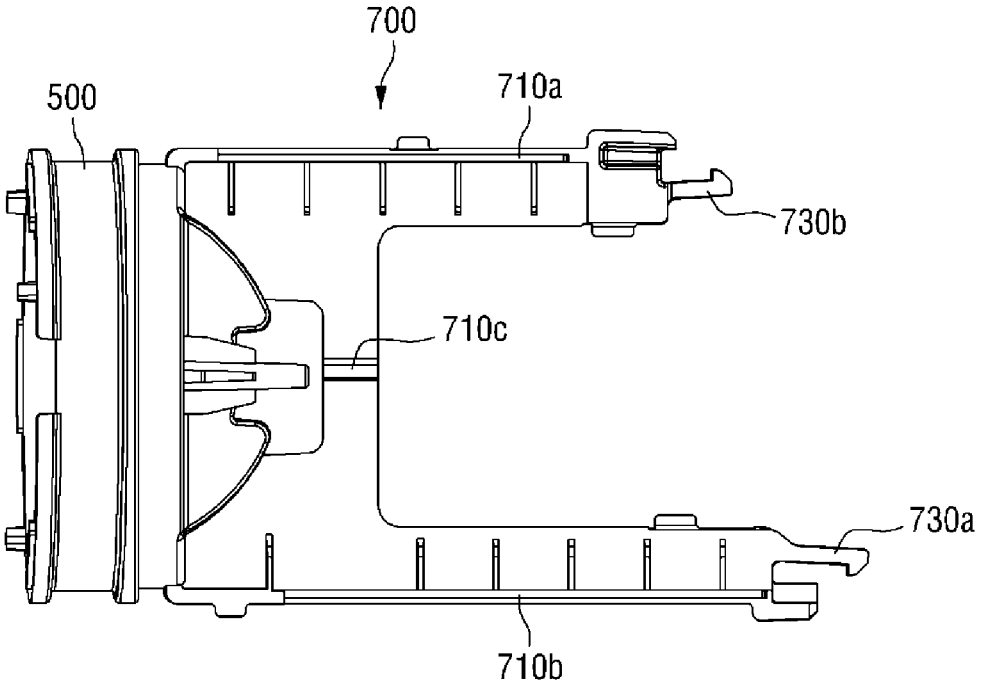
FIG. 25 is an exemplary bottom view of the supporting plate and a reflector of the headlamp of FIG. 18.
Figure 26:
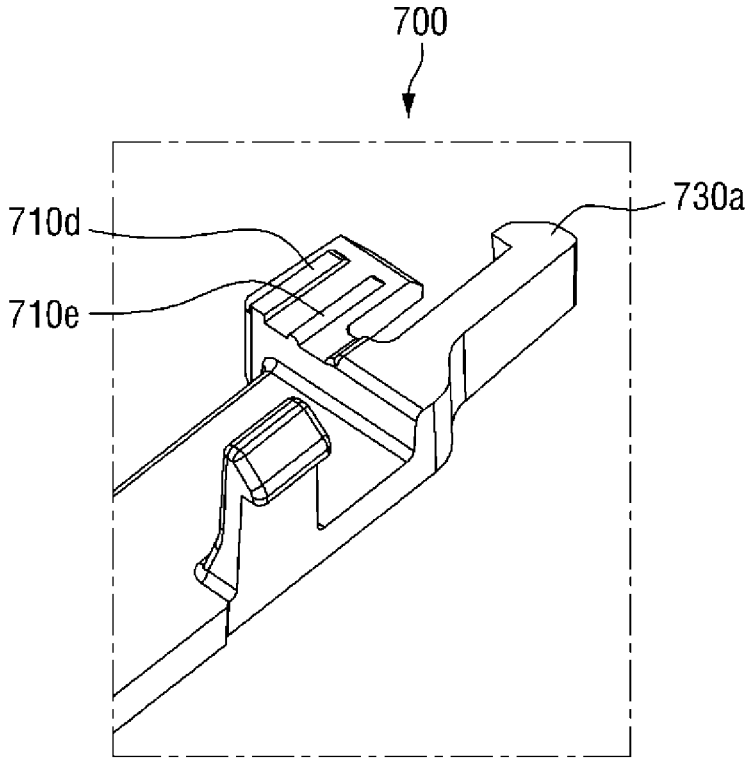
FIG. 26 is an exemplary bottom view of the supporting plate of the headlamp of FIG. 18.
Figure 27:
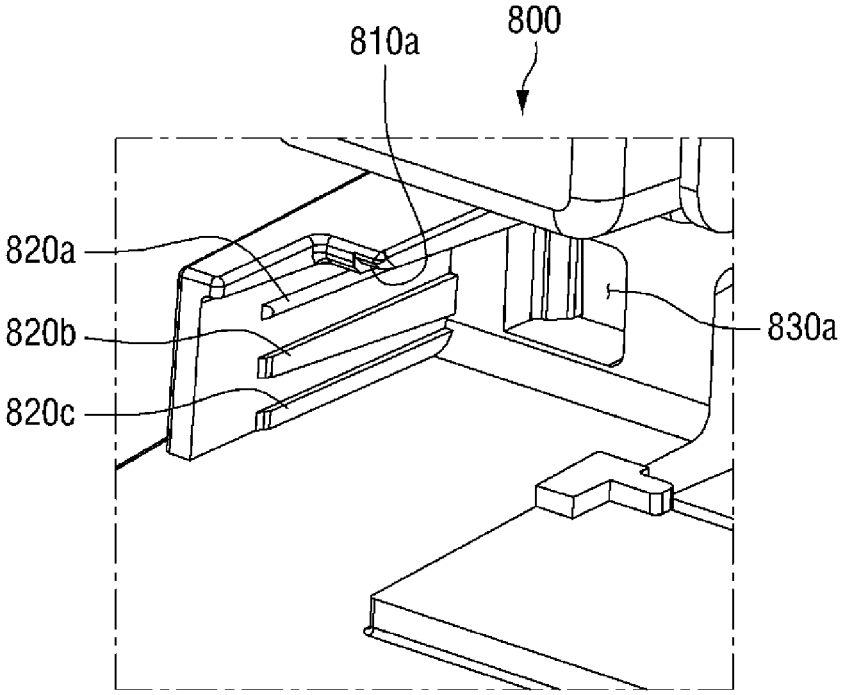
FIG. 27 is an exemplary partial view of the supporting plate of the headlamp of FIG. 18.

FIG. 18 is an exemplary perspective view of a headlamp for a vehicle according to still another exemplary embodiment of the invention, FIG. 19 is an exemplary exploded perspective view of the headlamp, FIG. 20 is an exemplary partial view of a heat sink of the headlamp, FIG. 21 is an exemplary front view of the heat sink of the headlamp, FIG. 22 is an exemplary assembled view of a supporting plate and the heat sink of the headlamp, and FIG. 23 is another exemplary front view of the heat sink of the headlamp, FIG. 24 is another exemplary assembled view of the supporting plate and the heat sink of the headlamp, FIG. 25 is an exemplary bottom view of the supporting plate and a reflector of the headlamp, FIG. 26 is an exemplary bottom view of the supporting plate of the headlamp, and FIG. 27 is an exemplary partial view of the supporting plate of the headlamp. Referring to FIGS. 18 to 27, a headlamp 50 for a vehicle includes a lens (not illustrated) disposed on an optical axis extending in a longitudinal direction of the vehicle, a light source (not illustrated) disposed at the rear of the focal point of the lens, a reflector 600 for reflecting light emitted from the light source forward, a supporting plate 700 coupled to a lower part of the reflector 600, a heat sink 800 coupled to the rear of the supporting plate 700 for dissipating heat generated by the light source, and a third coupling unit (730*a*, 730*b*, 830*a*, and 830*b*) and a fourth coupling unit (760, 770, and 860) for coupling the supporting plate 700 and the heat sink 800.

The expression "the direction of an optical axis", as used herein, refers to a longitudinal direction of a vehicle.

Also, a forward direction from a light source module including the lens, the light source, the reflector 600, the supporting plate 700 and the heat sink 800 refers to a direction toward the lens, and a rearward direction from the light source module refers to a direction toward the heat sink 800.

In exemplary embodiments, an LED may be used as the light source. The LED is a semiconductor device converting a current into light by utilizing the phenomenon that in response to the application of a voltage in a forward direction through the p-n junction of a semiconductor, electrons in the n region and holes in the p region meet each other and are recombined together to emit light. For example, a white LED with a chip size of 1 mm×1 mm may be used as the light source, but the invention is not limited thereto.

In an exemplary embodiment, the reflector 600 may be disposed above/over the light source, and may be formed to have a curved or elliptically curved shape with one surface thereof open to reflect light emitted from the light source. However, the invention is not limited to this exemplary embodiment. The light source may be disposed at a first focal point of the reflector 600.

The supporting plate 700 may be disposed at the front of the light source, and may include a shield unit, which forms a predetermined light distribution pattern by blocking at least a portion of the light emitted from the light source. The shield unit may be formed in the shape of a plate with a semicircular groove at one end thereof, but the shape of the groove may vary. The top surface of the shield unit may be formed of a material that can reflect at least some of the light reflected from the reflector 600 toward a lens included in a lens holder 500.

The heat sink 800 may be coupled to the rear of the reflector 600 and the supporting plate 700 for dissipating heat generated by the light source, thereby suppressing an increase in the temperature of the headlamp 50. The heat sink 800 may include a plurality of heat-dissipating fins, which are formed on at least one surface of the heat sink 800, to increase the heat-dissipating surface thereof.

As illustrated in FIGS. 20 to 27, the third coupling unit 730*a*, 730*b*, 830*a*, and 830*b*) includes a plurality of third hooks 730*a* and 730*b* disposed at one of the rear of the supporting plate 700 and the top of the heat sink 800 and a plurality of third engaging members 830*a* and 830*b* disposed at the other. The third hooks 730*a* and 730*b* are coupled to the third engaging members 830*a* and 830*b*, respectively, through snap fitting.

In an exemplary embodiment, two of the third coupling units (730*a*, 730*b*, 830*a*, and 830*b*) may be provided on both sides, respectively, at the top of the heat sink 800. In this exemplary embodiment, the third hooks 730*a* and 730*b* of each of the two third coupling units (730*a*, 730*b*, 830*a*, and 830*b*) may be coupled into their respective third engaging members 830*a* and 830*b* in different directions such that the barbs of the third hooks 730*a* and 730*b* of each of the two third coupling units (730*a*, 730*b*, 830*a*, and 830*b*) may face, for example, the left and right sides, respectively, of the heat sink 800.

If one or more of the third hooks are coupled in a different direction(s) from the rest of the third hooks, the headlamp 50 may become more robust against vibration and shock than when all of the third hooks are coupled in the same direction. Accordingly, the stability of the coupling of the supporting plate 700 and the reflector 600 may be ensured.

The fourth coupling unit (760, 770 and 860) includes a support 770 formed below the supporting plate 700 and extending in parallel to the supporting plate 700, a coupling rib 760 protruding from the support 770 to the bottom of the supporting plate 700, and a coupling recess 860 provided at a central part of the heat sink 800. The coupling rib 760 corresponds to, and is coupled to, the coupling recess 860.

The top surface of the support 770 may be coupled to the coupling recess 860 to contact the bottom surface of the coupling recess 860. If a central bottom surface of the supporting plate 700 is slidably coupled to a central top surface of the heat sink 800, the coupling rib 760 is coupled to the coupling recess 860, and the top surface of the support 770 is coupled to the central bottom surface of the heat sink 800 to which the support 770 is slidably coupled. Accordingly, the coupling surface of the supporting plate 700 and the heat sink 800 may be increased, and as a result, the supporting plate 700 and the heat sink 800 may be robustly coupled together.

Also, since the central bottom surface of the supporting plate 700 is slidably coupled to the central top surface of the heat sink 800 and the top surface of the support 770 is coupled to the central bottom surface of the heat sink 700 to which the supporting plate 700 is slidably coupled, the supporting plate 700 can be prevented from being laterally and vertically moved and the lens can be prevented from falling.

The coupling rib 760 and the coupling recess 860 may be coupled through snap fitting, boss coupling, and various other well-known coupling methods.

According to the still another embodiment, the headlamp 50 may also include a fifth coupling unit (740, 750, 840, and 850) for coupling the supporting plate 700 and the heat sink 800. The fifth coupling unit (740, 750, 840, and 850) connects a lower part of the supporting plate 700 and a lower part of the heat sink 800. As illustrated in FIGS. 20 to 23, the fifth coupling unit (740, 750, 840, and 850) includes a plurality of fifth hooks 740 disposed at one of the lower part of the supporting plate 700 and the lower part of the heat sink 800 and a plurality of fifth engaging members 840 provided at the other. The fifth hooks 740 may be coupled to the fifth engaging members 840, respectively, through snap fitting.

The third engaging members 830*a* and 830*b* and the fifth engaging members 840 each may include engaging holes or engaging protrusions. When the assembly of the headlamp 50 is completed, the barbs of the third or fifth hooks that are coupled to the engaging holes may be located inside the engaging holes, respectively, and the barbs of the third or fifth hooks that are coupled to the engaging protrusions may be located at bent portions of the engaging protrusions, respectively. As a result, the movement of the supporting plate in the direction of the optical axis can be suppressed.

The fifth coupling unit (740, 750, 840, and 850) may also include a plurality of pins 750 disposed at one of the lower part of the supporting plate 700 and the lower part of the heat sink 800 and a plurality of coupling holes 850 disposed at the other. The pins 750 are coupled to the coupling holes 850, respectively, through a boss structure.

The pins 750 may have blunt or sharp ends, and correspond to the coupling holes 850, respectively. When the assembly of the headlamp 50 is completed, the pins 750 may be located inside the coupling holes 850, respectively. The cross-sectional height of the boss structure of the pins 750 and the coupling holes 850 may vary along the direction of the optical axis.

For example, the cross-sectional height of the pins 750 and the coupling holes 850 may gradually increase or decrease in a direction toward the supporting plate 700 or the heat sink 800, and as a result, as the coupling of the pins 750 and the coupling holes 850 proceeds, the cross-sectional contact area of the pins 750 and the coupling holes 850 may gradually increase.

Due to the boss structure, lateral and vertical movement of the supporting plate 700 can be suppressed.

Since the third coupling unit (730*a*, 730*b*, 830*a*, and 830*b*) connects the supporting plate 700 and the heat sink 800 through snap fitting and the fifth coupling unit (740, 750, 840, and 850) also connects the supporting plate 700 and the heat sink 800 through snap fitting or boss coupling, a robust design of the headlamp 50 against vibration and shock may be possible without the need of screw coupling, and the assembly of the headlamp 50 may be improved.

In an exemplary embodiment, as illustrated in FIGS. 18 to 27, two of the third coupling units (730*a*, 730*b*, 830*a*, and 830*b*) and one of the fifth coupling unit (740, 750, 840, and 850) are provided, but the invention is not limited thereto. That is, there are no restrictions on the shape, location, and quantity in which to provide the third coupling unit (730*a*, 730*b*, 830*a*, and 830*b*) and the fifth coupling unit (740, 750, 840, and 850), respectively, as long as the third coupling unit (730*a*, 730*b*, 830*a*, and 830*b*) and the fifth coupling unit (740, 750, 840, and 850) can adequately couple the supporting plate 700 and the heat sink 800 from above or below the heat sink 800.

In an exemplary embodiment, as illustrated in FIGS. 18 to 27, the third hooks 730*a* and 730*b*, the fifth hooks 740, and the pins 750 are provided at the supporting plate 700, and the third engaging members 830*a* and 830*b*, the fifth engaging members 940, and the coupling holes 850 are provided at the heat sink 800. However, the invention is not limited thereto. For example, the third hooks 730*a* and 730*b*, the fifth hooks 740, and the pins 750 may be provided 700 at the heat sink 800 and the third engaging members 830*a* and 830*b*, the fifth engaging members 940, and the coupling holes 850 are provided at the supporting plate 700.

In an exemplary embodiment, as illustrated in FIG. 19, the fifth coupling unit (740, 750, 840, and 850) has a snap-fit structure. In an alternative exemplary embodiment, the fifth coupling unit (740, 750, 840, and 850) may have a boss structure or may have a snap-fit structure on one side thereof and a boss structure on the other side thereof.

In an exemplary embodiment, the third coupling unit (730*a*, 730*b*, 830*a*, and 830*b*) connects the rear of the supporting plate 700 and the top of the heat sink 800, the fourth coupling unit (760, 770, and 860) connects the lower part of the supporting plate 700 and a middle part of the heat sink 800, and the fifth coupling unit (740, 750, 840, and 850) connects the lower part of the supporting plate 700*a* and the lower part of the heat sink 800.

Since the third coupling unit (730*a*, 730*b*, 830*a*, and 830*b*), the fourth coupling unit (760, 770, and 860), and the fifth coupling unit (740, 750, 840, and 850) couple the upper, middle, and lower parts, respectively, of the heat sink 800 to the supporting plate 700, the supporting plate 700 and the heat sink 800 may be coupled together without the need to additionally determine points of coupling between the supporting plate 700 and the heat sink 800. Also, since the points of coupling between the supporting plate 700 and the heat sink 800 are not concentrated, but are rather uniformly spread, the supporting plate 700 and the heat sink 800 may be robustly coupled together.

As illustrated in FIGS. 24 to 27, the headlamp 50 may include a plurality of assembling ribs (710, 810, and 820) for coupling the supporting plate 700 and the heat sink 800.

The assembling ribs (710, 810, and 820) may include a plurality of first assembling ribs 710*a*, 710*b*, 710*c*, 710*d*, 710*e*, 710*f*, 710*h*, 710*i*, 710*j*, 710*k*, and 410*a* formed at at least one of the heat sink 800 and the supporting plate 700 for limiting vertical movement of the supporting plate 700. The assembling ribs may also include a plurality of second assembling ribs 820*a*, 820*b* and 820*c* formed at at least one of the heat sink 800 and the supporting plate 700 for limiting lateral movement of the supporting plate 700.

The first assembling ribs 710*a*, 710*b*, 710*c*, 710*d*, 710*e*, 710*f*, 710*g*, 710*h*, 710*i*, 710*j*, 710*k*, and 410*a* and the second assembling ribs 820*a*, 820*b* and 820*c* may fill any gaps between parts of the headlamp 50 that may be generated in vertical and lateral directions with respect to the supporting plate 700 due to manufacturing and assembly tolerances from the manufacture or assembly of the headlamp 50. Accordingly, the wobble of the supporting plate 700 and the heat sink 800 may be reduced even when the vehicle is vibrating, and the stability of the assembly of the headlamp 50 may be improved.

The height of the assembling ribs (710, 810, and 820) may vary along the direction of the optical axis. For example, as the assembly of the headlamp 50 proceeds, the height of the assembling ribs (710, 810, and 820) may gradually increase. Since the contact area of the supporting plate 700 and the heat sink 800 may be larger when the assembling ribs (710, 810, and 820) have different heights than when the assembling ribs (710, 810, and 820) have the same height, the assembly of the headlamp 50 may be further improved.

During the coupling of the supporting plate 700 and the heat sink 800, the assembling ribs (710, 810, and 820) may guide the supporting plate 700 and the heat sink 800 as to where they should be coupled to such that the central bottom surface of the supporting plate 700 can be slidably coupled to the central top surface of the heat sink 800.

As described above, the headlamps according to exemplary embodiments of the invention may include the first coupling unit (113*a*, 113*b*, 123*a*, and 123*b*) and the second coupling unit (114*a*, 114*b*, 124*a*, and 124*b*), which couple the supporting plate 110 and the reflector 120. Accordingly, it is possible to assemble a robust headlamp for a vehicle without the need of screw coupling. Also, the headlamps may also include the movement-limiting ribs (226*a*, 226*b*, 226*c*, 226*d*, 226*e*, and 236) provided at the heat sink 220 and the reflector 230. Accordingly, it is possible to improve the safety by preventing movement of the connector 300 without the need of additional screw coupling.

Also, the headlamps may also include the third coupling unit (730*a*, 730*b*, 830*a*, and 830*b*) and the fifth coupling unit (740, 750, 840, and 850). Accordingly, due to the snap fit structure or the boss structure provided by the third coupling unit (730*a*, 730*b*, 830*a*, and 830*b*) and the fifth coupling unit (740, 750, 840, and 850) and the presence of the second coupling unit (114*a*, 114*b*, 124*a*, and 124*b*), robust and efficient coupling and assembly are possible without the need of screw coupling at lower cost. Also, the headlamps may also include the assembling ribs (710, 810, and 820), making it possible to reduce manufacturing and assembly tolerances and improve product stability.

In exemplary embodiments of the invention, an LED may be used as a light source for a headlamp for a vehicle, but the invention does not exclude the use of various other light sources, such as a bulb-type light source.

In exemplary embodiments of the invention, two light source modules may be provided, but the invention can also be applied to a headlamp for a vehicle with a single light source module.

While the invention has been particularly shown and described with reference to exemplary embodiments thereof, it will be understood by those of ordinary skill in the art that various changes in provide and detail may be made therein without departing from the spirit and scope of the invention as defined by the following claims. The exemplary embodiments should be considered in a descriptive sense only and not for purposes of limitation.

The foregoing is illustrative of the present invention and is not to be construed as limiting thereof. Although a few embodiments of the present invention have been described, those skilled in the art will readily appreciate that many modifications and applications (e.g., application to rear lamps and other lamps for vehicles) are possible in the embodiments without materially departing from the novel teachings and advantages of the present invention. Accordingly, all such modifications are intended to be included within the scope of the present invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The present invention is defined by the following claims, with equivalents of the claims to be included therein.

What is claimed is:

1. A lamp for a vehicle, comprising:

a lens disposed on an optical axis extending in a longitudinal direction of the vehicle;

a light source disposed at a rear of a focal point of the lens;

a reflector for reflecting light emitted from the light source forward;

a supporting plate configured to support the lens and the reflector;

a heat sink configured to be coupled to a rear of the supporting plate for dissipating heat generated by the light source; and a third coupling unit and a fourth coupling unit for coupling the supporting plate and the heat sink, wherein the third coupling unit connects the rear of the supporting plate and a top of the heat sink and the fourth coupling unit connects a lower part of the supporting plate and a central part of the heat sink, and wherein the fourth coupling unit comprises a support disposed spaced apart from the supporting plate, positioned below the supporting plate and extending in parallel to the supporting plate, a coupling rib protruding from the support to the bottom of the supporting plate, and a coupling recess provided at the center part of the heat sink, and the coupling rib corresponds to, and is coupled to, the coupling recess.

2. The lamp of claim 1, wherein the third coupling unit comprises a plurality of third hooks disposed at one of the rear of the supporting plate and the top of the heat sink and a plurality of third engaging members disposed at the other, and the third hooks are coupled to the third engaging members, respectively, through snap fitting.

3. The lamp of claim 1, wherein a top surface of the support is coupled to a bottom surface of the coupling recess.

4. The lamp of claim 1, further comprising:

a fifth coupling unit for coupling the supporting plate and the heat sink, wherein the fifth coupling unit connects the lower part of the supporting plate and a lower part of the heat sink.

5. The lamp of claim 4, wherein the fifth coupling unit comprises a plurality of fifth hooks disposed at one of the lower part of the supporting plate and the lower part of the heat sink and a plurality of fifth engaging members disposed at the other, and the fifth hooks are coupled to the fifth engaging members, respectively, through snap fitting.

6. The lamp of claim 4, wherein the fifth coupling unit comprises a plurality of pins disposed at one of the lower part of the supporting plate and the lower part of the heat sink and a plurality of coupling holes disposed at the other, and the pins are coupled to the coupling holes, respectively, through a boss structure.

7. The lamp of claim 6, wherein a cross-sectional height of the boss structure varies along a direction of the optical axis.

8. The lamp of claim 1, further comprising:

a plurality of assembling ribs for coupling the supporting plate and the heat sink.

9. The lamp of claim 8, wherein the assembling ribs comprise a plurality of first assembling ribs formed at at least one of the heat sink and the supporting plate for limiting vertical movement of the supporting plate.

10. The lamp of claim 8, wherein the assembling ribs comprise a plurality of second assembling ribs formed at at least one of the heat sink and the supporting plate for limiting lateral movement of the supporting plate.

11. The lamp of claim 8, wherein a height of the assembling ribs varies along a direction of the optical axis.

12. A lamp for a vehicle, comprising:

a lens disposed on an optical axis extending in a longitudinal direction of the vehicle;

a light source disposed at a rear of a focal point of the lens;

a reflector for reflecting light emitted from the light source forward;

a supporting plate configured to support the lens and the reflector;

a heat sink configured to be coupled to a rear of the supporting plate for dissipating heat generated by the light source;

a third coupling unit and a fourth coupling unit for coupling the supporting plate and the heat sink, wherein the third coupling unit connects the rear of the supporting plate and a top of the heat sink and the fourth coupling unit connects a lower part of the supporting plate and a central part of the heat sink, wherein the fourth coupling unit comprises a support formed below the supporting plate and extending in parallel to the supporting plate, a coupling rib protruding from the support to the bottom of the supporting plate, and a coupling recess provided at the center part of the heat sink, and the coupling rib corresponds to, and is coupled to, the coupling recess, a fifth coupling unit for coupling the supporting plate and the heat sink, wherein the fifth coupling unit connects the lower part of the supporting plate and a lower part of the heat sink, and wherein the fifth coupling unit comprises a plurality of fifth hooks disposed at one of the lower part of the supporting plate and the lower part of the heat sink and a plurality of fifth engaging members disposed at the other, and the fifth hooks are coupled to the fifth engaging members, respectively, through snap fitting.

13. A lamp for a vehicle, comprising:

a lens disposed on an optical axis extending in a longitudinal direction of the vehicle;

a light source disposed at a rear of a focal point of the lens;

a reflector for reflecting light emitted from the light source forward;

a supporting plate configured to support the lens and the reflector;

a heat sink configured to be coupled to a rear of the supporting plate for dissipating heat generated by the light source;

a third coupling unit and a fourth coupling unit for coupling the supporting plate and the heat sink, wherein the third coupling unit connects the rear of the supporting plate and a top of the heat sink and the fourth coupling unit connects a lower part of the supporting plate and a central part of the heat sink, wherein the fourth coupling unit comprises a support formed below the supporting plate and extending in parallel to the supporting plate, a coupling rib protruding from the support to the bottom of the supporting plate, and a coupling recess provided at the center part of the heat sink, and the coupling rib corresponds to, and is coupled to, the coupling recess, a fifth coupling unit for coupling the supporting plate and the heat sink, wherein the fifth coupling unit connects the lower part of the supporting plate and a lower part of the heat sink, and wherein the fifth coupling unit comprises at least a pin disposed at one of the lower part of the supporting plate and the lower part of the heat sink and at least a coupling hole disposed at the other, and the pins are coupled to the coupling holes, respectively, through a boss structure.

* * * * *